United States Patent [19]

Bach

[11] Patent Number: 4,730,184

[45] Date of Patent: Mar. 8, 1988

[54] NEIGHBORHOOD AUDIO-VISUAL ALARM SYSTEM

[76] Inventor: Arthur Bach, 829 N. 10th Ave., Phoenix, Ariz. 85007

[21] Appl. No.: 801,192

[22] Filed: Nov. 25, 1985

[51] Int. Cl.[4] ..... G08B 13/00

[52] U.S. Cl. ..... 340/691; 340/539; 340/574

[58] Field of Search ..... 340/691, 574, 539, 541, 340/528, 529, 527

[56] References Cited

U.S. PATENT DOCUMENTS

| | | | |
|---|---|---|---|
| 3,133,276 | 5/1964 | Miller | 340/533 |
| 3,825,833 | 7/1974 | Bogue et al. | 340/574 |
| 3,909,826 | 9/1975 | Schildmeier et al. | 340/539 |
| 4,047,165 | 9/1977 | Andreasson et al. | 340/691 |
| 4,212,003 | 7/1980 | Mishoe et al. | 340/691 |
| 4,288,784 | 9/1981 | Fusco | 340/539 |
| 4,446,454 | 5/1984 | Pyle | 340/541 |

FOREIGN PATENT DOCUMENTS

| | | | |
|---|---|---|---|
| 2102607 | 2/1983 | United Kingdom | 340/574 |

*Primary Examiner*—Glen R. Swann, III

*Attorney, Agent, or Firm*—Charles P. Padgett, Jr.

[57] ABSTRACT

The proposed invention finds particular use in homes which do not have and/or in which the occupants cannot reach a telephone for phoning the police when an emergency condition exists, but which rely on neighbors, who do have telephones, observing the existence of an emergency condition and telephoning it in to the appropriate agency. The system includes an audio signal generator, either alone or packaged with a visual alarm, signal generator. Typically, the system includes a wall plate switch plate mounted on the interior of the dwelling with the system controls including a circuit board with a power supply, electronic delay and relay circuitry mounted in a convenient location. Alternately, a remote control unit can be used for alarm actuation. Under a potential alarm condition, such as when an unknown person comes to the door, the person within the dwelling can press a first SET switch which begins to time out a predetermined time delay or time interval. The person can then go to the door, and if there is no trouble, he can return and activate a RESET switch to prevent actuation of the alarm at the end of the delay period and return the system to it's initial condition. If, however, an emergency condition exists, he can press an emergency switch button to immediately bypass or override the delay and actuate the audio-visual alarm enunciator.

15 Claims, 6 Drawing Figures

NEIGHBORHOOD AUDIO-VISUAL ALARM SYSTEM

BACKGROUND OF THE INVENTION

Field of the Invention

The present invention relates generally to an audio-visual alarm system, and more particularly to an audio-visual alarm system uniquely adapted for neighborhoods in which many of the homes do not have telephones and/or in which some residents cannot reach the telephone, and wherein the alarm may be actuated at the end of a delay period or immediately under emergency conditions using a wall-mounted switching panel and/or a remote control unit.

Description of the Prior Art

The prior art contains a seemingly endless supply of security alarm systems. Such alarm systems have been around for many years and continue to grow ever more effective at protecting property and human lives within a dwelling or the like, ever more complex and difficult to install and maintain, and ever more costly.

One type of alarm system commonly employed in many of today's homes involves various types of detector systems such as ultrasonics, open/closed conductor loops, sound sensors, motion sensors, radar-type sensors, and many similar types of circuits or detectors provided in, on, or about the premises for detecting the presence of intruders or would-be intruders and generating an alarm signal, usually over dedicated alarm lines, cable TV lines, or conventional telephone lines to the nearest police, ambulance, or fire agency serving that district.

These systems are very expensive to install initially, are very expensive to maintain, and charge quite substantial sums of money for monthly protection, and are therefore far beyond the capabilities of ordinary home owners, particularly that category of home owners who cannot even afford a telephone.

Many alarm systems utilize huge computer complexes for keeping track of imput and output signals over cable TV, telephone lines, dedicated lines, and the like. Still others may set off only on-premises alarms to try and frighten the burglars away, and many assorted types of sensors and detection triggers are usually provided.

The prior art trend has been toward the adaption of more and more modern or complex electrical circuitry and systems; toward greater installation costs; toward greater operating and maintenance costs; toward greater monthly or yearly costs; and hence they totally fail to meet the long-felt need of a security type system for relatively low or middle income homes.

It is an object of the present invention to provide a low cost security system which can be used in low or medium cost housing units.

It is another object of the present invention to provide a system which can be easily installed by the home owner himself.

It is still another object of the present invention to provide an alarm system which is easy to install, involves a low installation cost, is easy to maintain, requires little or no expenditure of energy, and is well within the financial reach of even relatively poor homeowners.

It is still another object of the present invention to provide a combination audio alarm and visual alarm which can be mounted at a readily visible location such as on the roof or exterior wall of a home or residence so that when an alarm condition is annuciated, neighbors who do have telephone can hear and/or visually observe the emergency condition and telephone the appropriate authorities.

It is yet another object of the present invention to provide a relatively low cost alarm system which can be located on an exterior surface of the building while a switching panel located on an interior surface of the building can be used for actuation purposes.

It is still andother object of this invention to provide a panel including a SET switch for initiating a time delay period, a RESET switch for terminating the time delay period and restoring the initial circuit operation, and an emergency button EMERG for bypassing the delay and initiating or actuating the alarms immediately.

It is still another object of the present invention to provide a remote control unit and receiver means for controlling the operation of the Set, Reset, and Emergency functions, from a location remote from the wall panel and the exterior location of the audio and visual alarm devices.

It is yet a further object of the present invention to provide a simple, low cost, easy-to-maintain, easy-to-install, audio-visual alarm package which can be plugged or threaded into an outside light receptacle and operated from an interior light switch.

BRIEF SUMMARY OF THE INVENTION

The present invention solves substantially all of the problems of the prior art without including any of its disadvantages. It provides an extremely simple and easy-to-install unit having a low installation cost, a low maintainence cost, and almost no operating cost. It has no monthly or annual service charges, and uses little if any electrical energy, except when actuated. The present invention is particularly useful in neighborhoods where some of the homes do not have telephones and/or the occupants can't reach the telephone, or the like. These homes are at the mercy of intruders, muggers, rapists, robbers and the like, and the people living therein, who cannot afford telephones, can certainly not afford any of the expensive alarm systems on the market today.

The present invention is particularly adapted for use in such homes, and one or both of the audible alarm signal generating means and the visual alarm signal generating means can be located in an out-of-the-way, yet readily visable, location such as on the roof, above the garage door, high on an outside wall, or even in the normal porch light location above or proximate the door. In this location, whenever the alarm is initiated, neighbors who do have telephones can hear the alarm and/or see it so that they are aware of the existence of an emergency condition at that address, and they are able to use their telephones to telephone the appropriate agency to provide the necessary police, fire, medical agency, or the like.

In the preferred embodiment of the present invention, a system is provided which includes a roof or exterior wall-mounted halogen or otherwise bright light with a flasher unit and a red lens for blinking on and off for visually annuciating or indicating the existence of an alarm condition. Associated therewith, and usually in the same package, a driver amplifier and speaker are disposed for broadcasting a loud audible sound indicative of the existence of an emergency condition as well. In one embodiment, a wall-mounted panel includes a SET switch which may be manually-operated, such as when a person comes to the door and the person may not be known to the occupant, for initiating a predetermined time delay. Now the person can open the door, probably with the chain in place, and if there if any trouble or emergency condition, the alarm will automatically go off after the time interval has run its course. If the person is a friend, the occupant can press a RESET button to restore the system to its normal condition and prevent alarm actuation. Likewise, if an emergency condition is discovered, an emergency switch EMERG can be depressed which bypasses the delay and activates the alarms immediately.

In an alternate embodiment, a remote control unit can be provided, either in conjunction with or separate from, the use of the wall-mounted-switching panel. The remote control unit can be a conventional radio transmitter device, such as a garage door opener, which can be manually-operated to control the same SET, RESET, and Emergency functions, as indicated on the wall panel and transmit these to a receiver device which then serves to operate the electronic delay timer, relay, and the like.

Furthermore, a single, low cost, audio-visual enunciator is contemplated which can be electrically connected directly to an exterior electrical receptacle supplied with AC power for generating both an audible alarm signal and a visual alarm signal. The sound-generating unit includes means for operatively coupled to the electrical receptacle, and receptacle means for operatively receiving an illumination means for completing an AC path therethrough. A protective shield or colored lens, preferably unbreakable, may be placed over the illumination means to protect the light bulb and make it extremely difficult for the intruder or criminal to destroy the apparatus before the alarm condition has been noticed. Flasher means can be added to turn the illumination means on and off or turn the audible signal on and off, or both.

These and other objects and advantages of the present invention will be more fully understood after reading the detailed description of the preferred embodiment, the claims, and the drawings, which are briefly described hereinbelow.

DETAILED DESCRIPTION OF THE DRAWINGS

Figure 1:
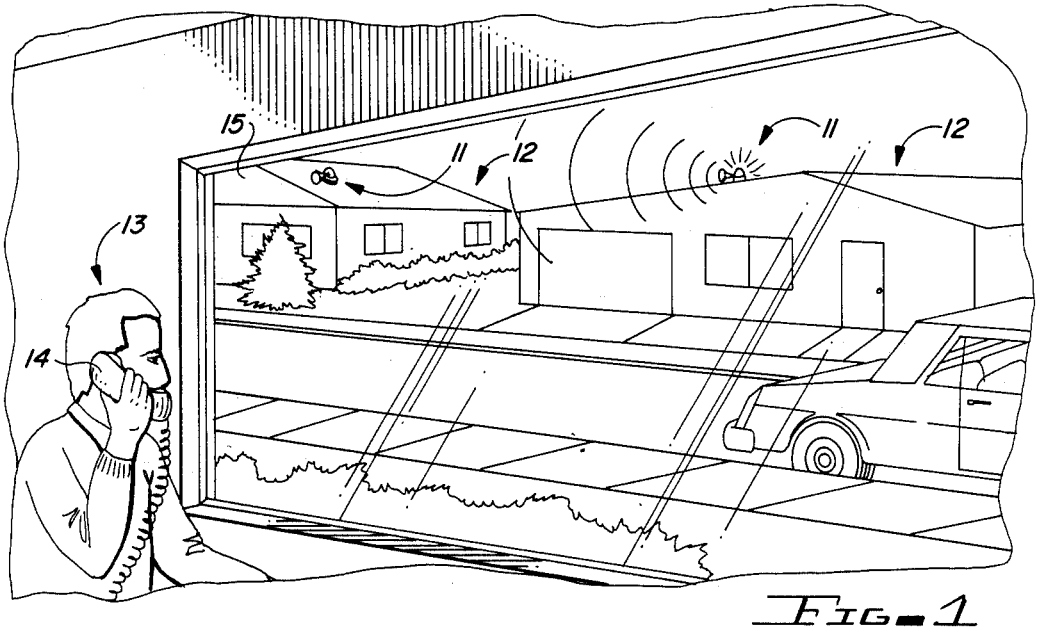
FIG. 1 shows a general pictoral view of a person with a telephone observing an alarm condition in a neighbor's house without a telephone and/or in which the occupant cannot quickly reach a telephone, and phoning the appropriate agency.

FIG. 1 illustrates the audio visual alarm enunciator system 11 of the present invention as being operatively mounted on the roof of a home, house, or dwelling 12. An observer 13, within a house which is provided with a telephone 14, has observed the flashing light 11 through his window 15 or hears the audible alarm signal and is using his telephone 14 to telephone the police, fire station, ambulance, or appropriate service agency to advise them of the alarm condition.

Figure 2:
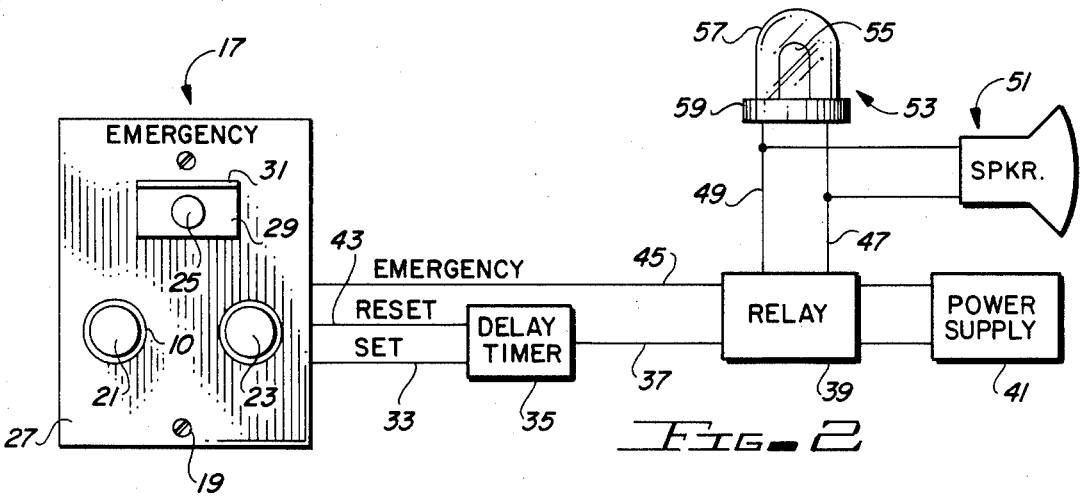
FIG. 2 is a block diagram of the preferred embodiment of the alarm system of the present invention.

FIG. 2 is a block diagram of the preferred embodiment of the system of the present invention, and it includes a wall panel or panel unit 17 which is adapted to be mounted on the interior surface of a wall of the dwelling 12 as by threaded fasteners 19 or any conventional fasteners, as known in the art. The panel 17 includes a first switching means or "SET" switch 21, a second or "RESET" switch 23, and an emergency switch (EMERG) 25. The switches 21, 23, and 25 are mounted in the wall unit 17, as through apertures 10 in a face plate 27 or the like and the wall unit 17 may be concealed from sight, if desired. Furthermore, to prevent inadvertent operation of the emergency switch 25, a protective door, flap, or covering 29 is hingedly coupled, via connector 31, to the face plate 27 so that the EMERG button 25 cannot normally be reached unless the protective portion 29 is manually lifted and the emergency button 25 therebeneath pressed while the protective cover 29 remains lifted. The entire panel 17 could also be provided with a closable cover, which could be lockable, and which could lock automatically once the alarm is initiated and the cover is closed.

The output from the SET switch 21 is taken on lead 33 and connects to one input of a conventional delay timer 35 which initiates a predetermined delay period or time interval upon activation of the SET switch 21. The output of the delay timer 35 is supplied, via lead 37, to one input of a relay system 39 which also has two terminals connected directly to the power supply or source of potential 41. Similarly, the RESET switch 23 is electrically connected, via lead 43, to a second input of the delay timer 35, and the emergency switch 25 has its output connected, via lead 45, to the other input of relay 39. One output of relay 39 is supplied, via lead 47, to a first input of the speaker 51 and to the first input of the light unit 53. Similarly, the second output of the relay 39 is supplied, via lead 49, to the second input of speaker 51 and 10 the second input of the light unit 53. The light unit 53 preferably includes a halogen or ultrabright light source 55, a red or colored protective lens 57, and a base 59 which may include a flasher unit, as known in the art. The light may include, for example, a rotating light such as is conventionally mounted on the top of a police vehicle, flashing or blinking lights, flashing or blinking colored lights, alternating colored or bicolored lights such as those conventionally found on many of today's emergency vehicles, strobe lights, rotating beacon lights, and the like.

In operation, when someone comes to the door and the person inside the house does not know whether or not it is a friend or a potential intruder, robber, terrorist, rapist, mugger, or the like; he manually presses or depresses the SET switch 21, either on the wall panel of FIG. 2 or on a corresponding switch on the remote control unit, as hereinafter described with reference to FIG. 3. He can now proceed to answer the door. If there is any trouble with the person at the door, he simply does nothing. Since the SET switch 21 automatically initiated or started the timing of the predetermined interval, such as two minutes, at the expiration of this time period, the very loud siren will sound, and the red flashing light will actuate to alert neighbors of the existence of trouble or an emergency condition. They will then use their telephones to telephone police or the appropriate authorities to send help.

If, on the other hand, the person at the door is a friend, the RESET button 23 will be depressed to terminate the counting of the time delay and restore the circuit to its initial state or condition. Lastly, if the person knows that it is an emergency condition, as indicated perhaps by criminals breaking in the door, he immediately lifts the protective covering 29 and depresses the emergency switch button EMERG 25 to bypass the delay timer 35 and immediately cause the relay 39 to supply power from the power supply 41 to the speaker 51 and light 53 to activate the audio and visual alarm enunciator and place the neighbors on alert as to the existence of the emergency condition.

The electronic control circuit board is the heart of this system and the SET, RESET and emergency (EMERG) push button switches are connected to the control board. When the SET button is pushed, power is supplied to the timing circuits in the electronic delay timer and at the end of the timing cycle, the relay is energized and power is supplied to the siren driver and halogen light for indicating the alarm condition. The RESET button interrupts the timing cycle and puts the system back in the original standby mode. The emergency button EMERG bypasses the timing circuitry and immediately activates the alarm indicators.

Figure 3:
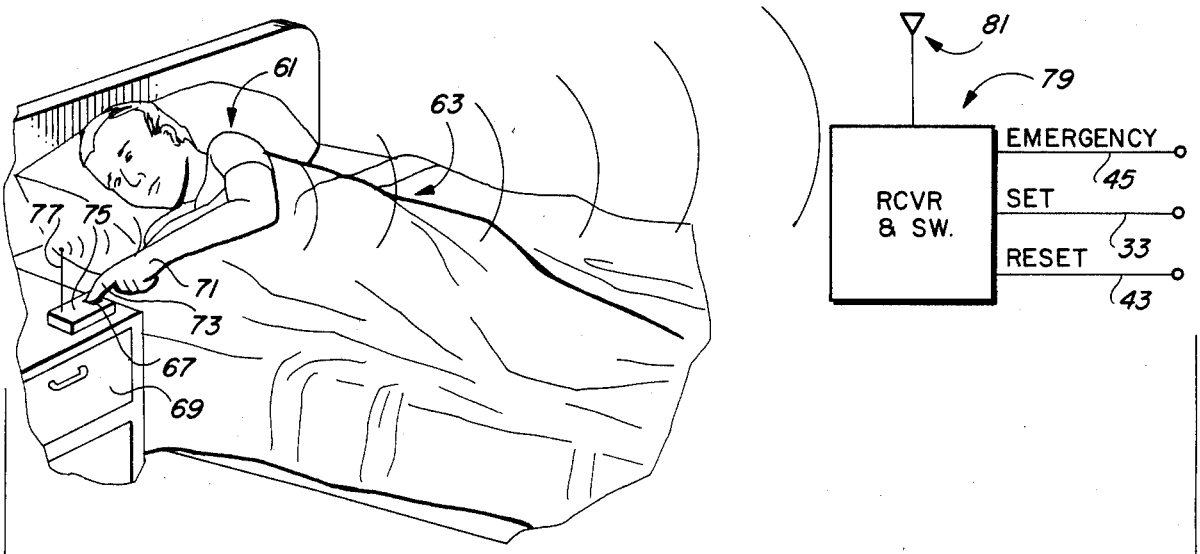
FIG. 3 is an illustrative diagram of the system of FIG. 2 operated with a remote control unit rather than a wall panel switch.

FIG. 3 shows a person or occupant 61 of the house 12 as being bedridden or confined to a bed 63. This person, however, is provided with a remote control unit 75 which has the appropriate control buttons 67 thereon. The remote control unit can be placed on the bed, clipped to the person's clothing, held in his hand, or placed on a nearby nightstand 69, as shown in FIG. 3. The person 61 lying on the bed 63 may hear a noise, such as somebody breaking down his door or attempting to pry open a window, and he can use a hand 71 or a finger 73 on his hand 71 to depress the appropriate switch button 67, which corresponds to any one of the SET button 21, RESET button 23, or emergency EMERG button 25 of the remote control unit 75 to transmit a radio signal, infrared signal, or the like over the antenna 77 to a receiver unit 79 which receives the transmitted signals on its antenna 81 and supplies the appropriate SET signal information, RESET signal information, or emergency EMERG signal switch information to the circuit of FIG. 2, via leads 33, 43, and/or 45, respectively.

Figure 4:
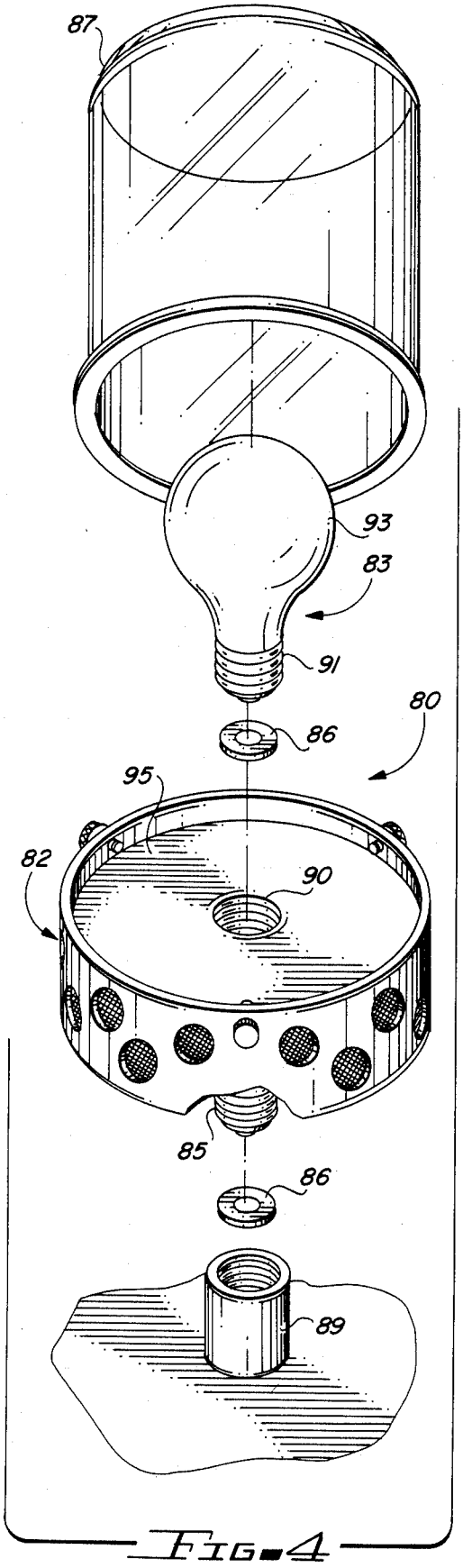
FIG. 4 is an exploded perspective view of the low cost audio-visual enunciator system forming part of or used in the system of the present invention.

FIG. 4 is an exploded view of a very low cost package or assembly 80 which includes a generally cylindrical sound generating portion 82, an illumination device or light bulb 83, an electrical connector portion 85, one or more flashers 86, a tinted lens or protective shield or casing 87, and an outside electrical receptacle 89, such as a conventional door light, porch light, garage door light, or the like. The flasher units 86 can be placed into the hollow internally-threaded receptacles of the external wall socket 89 or the hollow internally-threaded electrical receptacle 90 of the sound-generating unit 82. When, for example, the electrical connector portion 85 of the unit 82 is threadedly screwed into the internal threads of the receptacle 89, the unit 82 is both electrically and physically secured to the building 12. Similarly, the receptacle portion 91 of the halogen or other bright bulb 83 is threadedly screwed into or inserted within the internally-threaded socket 90 of the sound unit 82 to form a single, interconnected, unitary package 80 wherein all of the components are electrically and physically coupled into a single, integral, low cost package. Similarly, the tinted lens, shield, or protective covering 87 can be placed over the glow portion 93 of the halogen bulb 83 and secured to the top surface 95 of the sound unit 82 to complete the structure.

Figure 5:
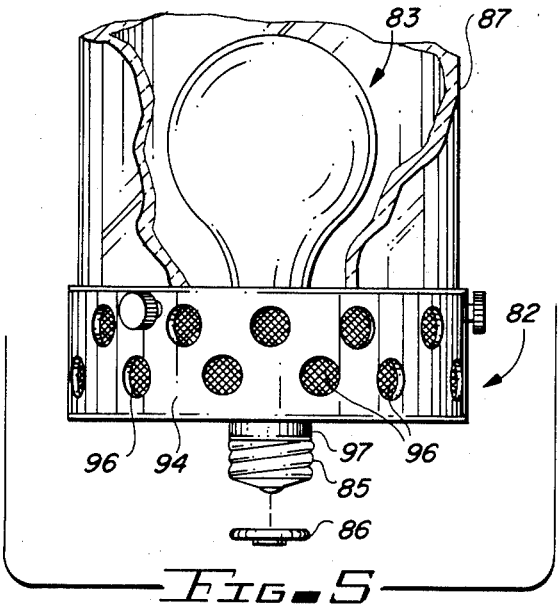
FIG. 5 is a side view of the assembled apparatus of FIG. 4.

FIG. 5 shows the unit of FIG. 4 assembled and more clearly shows, in a side view, the integral socket-like connector portion on the base of the sound unit 82.

Figure 6:
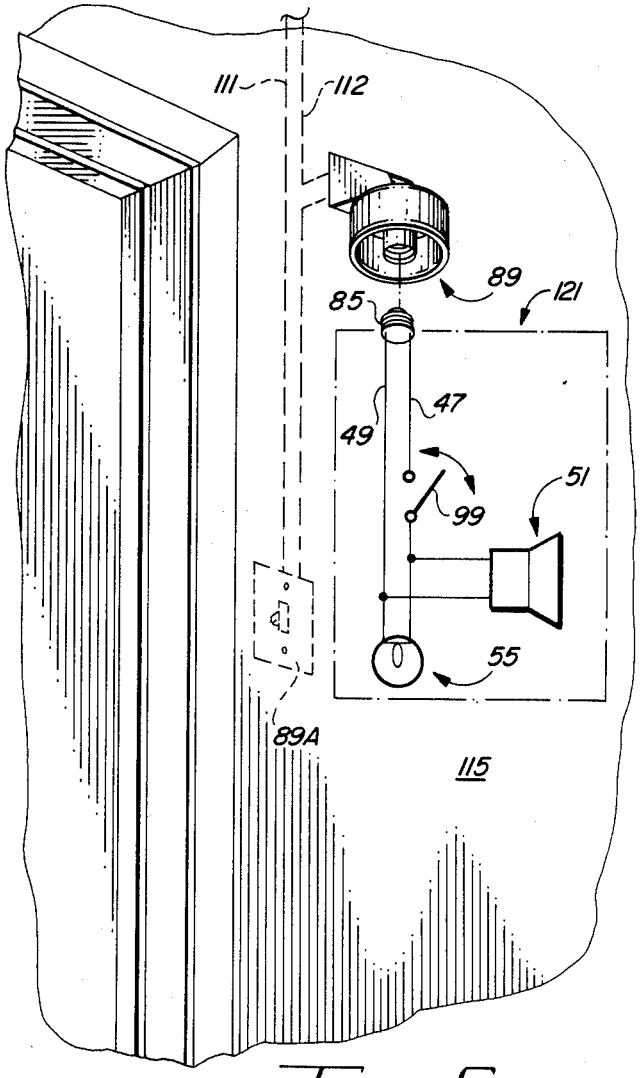
FIG. 6 is an electrical schematic diagram of the combination of FIGS. 4 and 5.

Lastly, FIG. 6 shows an electrical circuit representing the AC-connected circuit of FIG. 4 with a pair of input lines 111, 112 connected between the 110 volt AC outlet (not shown in FIG. 6) the conventional screw-in type socket 89 and connected to the two inputs of the speaker 51 and the two inputs of the halogen lamp 55, with all couplings being made within the conventional screw-in type socket 89 and the conventional screw-in type socket 90 through socket connectors 85 of FIG. 6 and 91A, of FIG. 4. As illustrated, both the speaker 51 and the lamp 55 are located together within the package or unit represented by the dashed lines designated with reference numeral 121. Furthermore, FIG. 5 shows a base or interconnecting portion 97 for extending the externally-threaded socket-engaging portion 85 from the lower surface of the cylindrical portion 82. The outer peripheral cylindrical walls 94 of the sound-generating unit 82 of FIG. 4 are provided with a plurality of apertures 96 to enable the generated sound to readily escape therefrom and travel great distances for alerting neighbors even at a consider distance therefrom.

In the present example, a single switch 89A, such as that which normally controls the outside porch light, garage light, or other outside electrical receptacle, which can be actuated by a simple on-off switch 89A mounted on a wall 115 within the dwelling, is used to actuate or de-actuate the alarm devices. Furtermore, FIG. 6 shows that the sound device 51 and the illumination means 55 are wired in parallel via leads 47 and 49, with lead 47 including a normally-open switch member 99 operatively disposed therein, and not in series so that an electrical malfunction in either one will not effect the operation of the other.

With this detailed description of the preferred embodiment of the present invention, it will be understood by those skilled in the art that various modifications, variations, substitutions and changes can be made in both the circuits, apparatus, and structures of the present invention, without departing from the spirit and scope of the invention, as set forth in the appended claims.

I claim:

1. An alarm system for protecting a dwelling comprising:

a source of electrical energy;

means for generating an audible alarm signal;

means for generating a visual alarm signal;

means for supplying said electrical energy to said signal-generating means;

manually-operable means located within a dwelling to be protected for generating a trigger signal;

relay means operatively coupling said source of electrical energy to said alarm signal-generating means, said relay means being normally open to disconnect said source of electrical energy from said alarm signal-generating means and being responsive to the generation of said trigger signal for closing to connect said source of electrical energy to said alarm signal-generating means for turning on both said audio and visual alarm signals;

said manually-operable means including a manually-operable switch panel operatively disposed on an interior surface of the dwelling;

said switch panel including a first manually-operable switching means for initiating a predetermined time delay;

means responsive to the expiration of said predetermined time delay for generating said trigger signal;

reset switch means for resetting said first switch means to its initial condition and resetting said predetermined time delay period to zero; and an emergency switch means for immediately generating said trigger signal without waiting for said predetermined time delay to elapse;

said alarm signal-generating means including:

a means for operatively engaging an electrical receptacle;

means for supplying electrical energy thereto;

means for generating an audible signal, said audible signal-generating means including a housing being integral with said means for engaging an electrical receptacle; said housing including an electrical light receptacle; and illumination means adapted to be operatively received within said electric light receptacle of said housing for supplying said electrical energy to said illumination means, said illumination means further including a protective covering for operatively shielding said illumination means from breakage.

2. The alarm system of claim 1 wherein said means for generating alarm signals are operatively disposed on an out-of-the-way yet readily visible portion of the exterior of the dwelling.

3. The alarm system of claim 1 wherein said alarm signal-generating means is operatively mounted on the roof of said dwelling.

4. The alarm system of claim 1 wherein the alarm signal-generating means is operatively coupled to an upper portion of the exterior wall of the building substantially out of the reach of the potential intruder.

5. The alarm system of claim 1 wherein said manually-operable means further includes a remote control system including a remote control transmitter unit adapted to be at least one of carried by and positioned near the person occupying the dwelling, a remote receiver located proximate said alarm signal-generating means, said receiver being responsive to signals transmitted by said remote control transmitter unit for receiving said signals and generating said trigger signal in response thereto.

6. The alarm system of claim 1 further including protective means operably disposed over said emergency switching means to prevent the inadvertent actuation thereof, said protection means being manually positionable to expose said emergency switch means for operation thereof.

7. The alarm system of claim 1 further including flasher means adapted to be operatively disposed within said means for supplying electrical energy thereto for enabling at least one of said audible alarm means and said illumination means to be intermittently actuated to better attract the attention of neighbors thereto.

8. The alarm system of claim 1 wherein said protective covering includes an optically transmissive material.

9. The alarm system of claim 8 wherein said protective covering further includes means for readily transmitting sound therefrom.

10. The alarm system of claim 1 wherein said means for generating an audible alarm signal includes at least one of a siren, horn, bell, buzzer, warbler, an oscillating tone generator, and a whistle.

11. The alarm system of claim 1 wherein said means for generating a visual alarm signal includes at least one of a rotating police light, a strobe light, flashing lights, flashing colored lights, and alternating bi-colored flashing lights.

12. In an alarm system for a dwelling, said dwelling including electrical receptacle means on an exterior surface of said dwelling, an AC source of potential, an AC circuit coupled between said source of potential and said electrical receptacle means, and on-off switching means operatively disposed on an inner wall of said dwelling in said AC circuit for activating said exterior electrical receptacle means, an improved audio-visual alarm annunciator comprising:

audible alarm-generating means including an audible alarm housing, means operatively disposed within said housing for generating an audible alarm signal, and means for enabling the generated audible signal to be heard at relatively great distances therefrom, said audio alarm housing including an electrical connector means adapted to be readily connected to and removed from a conventional electrical receptacle on the exterior of said dwelling and a light socket operably disposed on an opposite surface thereof, an illumination means adapted to be operatively coupled to said light socket receptacle and a protective shield operatively covering said illumination means to prevent damage thereto.

13. The alarm system of claim 12 further including flasher means operatively insertable within the AC electrical circuit between said exterior electrical receptacle and said illumination means for intermittently operating at least one of said audible alarm signal-generating means and said illumination means.

14. The alarm system of claim 12 wherein said protective shield includes an optically transmissive material.

15. The alarm system of claim 14 wherein said protective shield further includes means for enabling sound to be emitted therefrom.

* * * * *